United States Patent [19]

Skoog

[11] Patent Number: 4,718,359

[45] Date of Patent: Jan. 12, 1988

[54] PROCESS AND A MEANS FOR BURNING SOLID FUELS, PREFERABLY COAL, TURF OR THE LIKE, IN PULVERIZED FORM

[75] Inventor: Kurt Skoog, Johanneshov, Sweden

[73] Assignee: Stubinen Utveckling Ab, Stockholm, Sweden

[21] Appl. No.: 816,140

[22] Filed: Jan. 3, 1986

Related U.S. Application Data

[62] Division of Ser. No. 569,901, Jan. 11, 1984, Pat. No. 4,569,295.

[30] Foreign Application Priority Data

Jan. 18, 1983 [DE] Fed. Rep. of Germany ..... 3301469
Mar. 18, 1983 [DE] Fed. Rep. of Germany ..... 3309905
Mar. 18, 1983 [DE] Fed. Rep. of Germany ..... 3309906

[51] Int. Cl.[4] ..... F23D 1/02

[52] U.S. Cl. ..... 110/264; 110/104 B; 110/265; 431/184; 431/186; 431/189

[58] Field of Search ..... 110/260, 261, 262, 263, 110/264, 265, 346, 347, 204, 104 R, 104 B; 431/9, 181–184, 186, 188, 189, 284

[56] References Cited

U.S. PATENT DOCUMENTS

| | | | |
|---|---|---|---|
| 1,532,041 | 3/1925 | Couch | 431/183 |
| 1,779,647 | 10/1930 | Van Brunt | 110/104 R |
| 1,795,454 | 3/1931 | Van Brunt | 431/184 |
| 2,329,468 | 9/1943 | Hardgrove | 110/104 B |
| 2,334,314 | 11/1943 | Campbell | 110/104 B |
| 2,380,463 | 7/1945 | Poole | 431/184 |
| 2,514,768 | 7/1950 | Kennedy | 110/104 B |
| 3,049,085 | 8/1962 | Musat et al. | 431/284 |
| 3,100,461 | 8/1963 | Werner | 431/189 |
| 4,217,132 | 8/1980 | Burge et al. | 431/9 X |
| 4,321,034 | 3/1982 | Taccone | 432/105 |
| 4,333,405 | 6/1982 | Michelfelder et al. | 110/264 |
| 4,348,168 | 9/1982 | Coulon | 431/9 |
| 4,350,103 | 9/1982 | Poll | 110/264 |
| 4,367,686 | 1/1983 | Adrian | 110/264 X |
| 4,422,391 | 12/1983 | Izuha et al. | 110/263 X |
| 4,523,529 | 6/1985 | Poll | 110/264 X |
| 4,523,530 | 6/1985 | Kaminaka et al. | 110/264 |

FOREIGN PATENT DOCUMENTS

| | | | |
|---|---|---|---|
| 0007894 | 2/1980 | European Pat. Off. . | |
| 0114062 | 7/1984 | European Pat. Off. . | |
| 1164013 | 2/1964 | Fed. Rep. of Germany . | |
| 1401826 | 11/1968 | Fed. Rep. of Germany . | |
| 1812405 | 6/1970 | Fed. Rep. of Germany . | |
| 2221843 | 3/1973 | Fed. Rep. of Germany . | |
| 2345838 | 3/1975 | Fed. Rep. of Germany . | |
| 2724532 | 12/1978 | Fed. Rep. of Germany . | |
| 735375 | 10/1931 | France . | |
| 735376 | 10/1931 | France . | |
| 880215 | 3/1942 | France . | |
| 1494620 | 9/1966 | France . | |
| 145316 | 7/1979 | German Democratic Rep. . | |
| 102630 | 8/1979 | Japan | 431/182 |
| 917708 | 2/1963 | United Kingdom . | |
| 952882 | 3/1964 | United Kingdom . | |
| 1165169 | 9/1969 | United Kingdom . | |
| 1495491 | 12/1977 | United Kingdom . | |

*Primary Examiner*—William E. Wayne
*Assistant Examiner*—Steven E. Warner
*Attorney, Agent, or Firm*—Lorusso & Loud

[57] ABSTRACT

An apparatus is described for burning solid fuels, preferably coal in pulverized form, which are mixed with a carrier liquid, such as water and/or oil or the like, to thereby form an emulsion, and for this purpose the fuel emulsion is injected through a substantially annular entrance port into a combustion chamber so that an approximately hollow cone-shaped flow configuration is produced. Within this flow configuration, a low pressure is built up immediately behind the entrance port for the fuel emulsion opening into the combustion chamber so that a portion of hot combustion gases and a remainder of unburnt fuel particles are recirculated to the entrance port. Furthermore, gas entrance ports are provided in the end wall of the combustion chamber, through which the gas or air flows, the path of flow of which extends concentrically and spirally towards the axis of the entrance port for the fuel emulsion opening into the combustion chamber. In this way, the fuel emulsion injected into the combustion chamber is set in rotation, whereby the hollow cone-shaped flow configuration is fanned out or expanded to a bell-shaped or apple-shaped configuration. This feature provides for an extremely long particle path in the shortest possible distance along the middle axis of the combustion chamber. Practically complete combustion is ensured within an extremely short combustion chamber.

12 Claims, 6 Drawing Figures

P—ADJUSTABLE VACUUM PUMP

P—ADJUSTABLE VACUUM PUMP

PROCESS AND A MEANS FOR BURNING SOLID FUELS, PREFERABLY COAL, TURF OR THE LIKE, IN PULVERIZED FORM

This is a division of application Ser. No. 569,901, filed Jan. 11, 1984 now U.S. Pat. No. 4,569,295.

BACKGROUND OF THE INVENTION

This invention concerns a process and a means for burning solid fuels, in particular coal, turf or the like in pulverized form, which are introduced into a combustion chamber and form a recirculating flow configuration which is limited by a rotating outer air flow. For this purpose the outer air flow is blown into the combustion chamber through an air entrance concentrically surrounding the fuel entrance, and the air entrance comprises swirl elements which set the air flow in rotation.

The aim of the present invention is in particular to ensure as complete and emission-free burning of the above-mentioned solid fuels as possible when they are mixed with a carrier liquid, such as water and/or oil or the like to thereby form an emulsion and are injected into the combustion chamber. Usually, such a fuel emulsion is injected through a tuyère-like opening in the combustion chamber and then forms a solid cone of fuel which hardly opens up, with the result that the combustion is carried out in a relatively long jet flame and is accordingly incomplete due to the resulting relatively small free fuel surface. Moreover, vary long combustion chambers are necessary.

DESCRIPTION OF THE PRIOR ART

German published application No. 2,806,363 discloses a process and a means for igniting a coal dust flame of the type described above. The means comprises a central coal dust duct, through which coal is introduced pneumatically (by means of air) into the ingition zone of the means. A hollow cone diffuser is arranged at the exit of the coal dust duct, by means of which the emerging coal dust is given a hollow cone-shaped flow configuration. The coal dust duct is arranged within a secondary air pipe and extends coaxially with respect to the latter such that an annular passage for secondary air is produced. The secondary air pipe is provided with a diverging orifice section in the region of the coal dust diffuser, which is the outer limit of the combustion chamber. Swirl elements are arranged in the secondary air pipe which impart rotation about the central axis of the means on the secondary air flow. Recirculation of hot combustion gases and unburnt fuel particles is produced by means of the outer secondary air flow, i.e. a backflow of the latter to the fuel entrance is obtained. In this way, a more stable flame is obtained.

Practical use has shown that the prior art measures applied in conjunction with the combustion of a fuel emulsion are not sufficient and that the stabilization of the flame is insufficient at various loads.

OBJECT OF THE INVENTION

It is therefore the object of the present invention to modify the known process and the known means so that a highly stable flame is obtained during all states of operation (ignition, partial load, full load) which at the same time provides for maximum combustion along the shortest possible path, i.e. in extremely short combustion chambers.

SUMMARY OF THE INVENTION

In accordance with the invention this object is solved by the use of a fuel emulsion which is produced from burning solid fuels. By one aspect of this invention there is provided a process for burning solid fuels, in pulverized form, which are introduced into a combustion chamber and whereby a recirculating flow configuration is formed, said flow configuration being limited by a rotating outer air flow, characterized in that the fuels are mixed with a carrier liquid, to form an emulsion which is introduced into the combustion chamber, and that the outer air flow is blown into the combustion chamber in a multiple of concentric partial flows, said partial flows being variable with respect to throughput and the flow velocities of said partial currents being reduced as they pass from the inside to the outside.

By introducing the fuel emulsion into the combustion chamber and forming a hollow cone-like flow configuration, the free fuel surface is substantially enlarged in a simple way and correspondigly complete combustion is achieved. By dividing the outer secondary air flow into a multiple of concentric partial flows and by being able to vary the partial flows with respect to their throughput, a maximum central recirculation of a portion of the hot combustion gases and small remainders of unburnt fuel particles to the fuel entrance is obtained at every operation or load state and hence the flame length is minimized while at the same time the fuel is almost completely burned and leaves no residue. In accordance with the invention it is possible to guide a portion of the hot combustion gases and small remainders of unburnt fuel particles at every operation or load state centrally up to immediately in front of the fuel entrance, whereby early ignition of the fuel emulsion injected into the combustion chamber is achieved. The distance of the flame from the fuel entrance is thereby minimized.

The recirculating remainder of unburnt fuel particles is, at the same time, combusted. Both effects enhance the stability of the flame, shorten the flame and provide a higher degree of combustion. The flame region is roughly apple-shaped. The flow velocities of the above-mentioned partial flows preferably decrease from the inside to the outside. The radial inner partial flows or the flows situated nearest to the fuel entrance have the primary task of breaking up the fuel cone so as to obtain an enlargement of the free fuel surface. The partial flows disposed radially somewhat farther out have, on the other hand, the primary task of limiting the fuel flow configuration or the flame and setting it in rotation so that a sufficiently large low pressure is produced immediately behind the fuel entrance, which low pressure initiates the above-mentioned circulation of a part of the hot combustion gases and the small remainders of unburnt fuel particles. Furthermore, the partial flows situated radially somewhat further out also have the task of building up a low pressure in the region of the end wall of the combustion chamber comprising the fuel entrance, which low pressure causes spontaneous fanning out of the fuel emulsion injected into the combustion chamber and hence and additional shortening of the flame. The shape of the fuel flow configuration or the flame is determined by the balance of the centrifugal forces acting on the fuel emulsion or flame and the "low pressure" forces acting around the periphery and in the centre. The build up of an outer low pressure can be additionally enhanced by deflecting at least the outer radial flow, radially towards the outside so that a secondary air flow is obtained which flows close to the wall containing the fuel entry to the combustion chamber.

Further detailed improvements of the inventive process and the inventive means are described in the subordinate claims, to which reference is expressly made. A feature which is particularly worthy of mention is the one claimed whereby an extremely strong effect of the outer air flow on the flow configuration of the fuel emulsion and a corresponding enlargement of the free or effective fuel surface is obtained along the shortest axial path.

If water is used as a carrier liquid for the solid pulverized fuel, the inventive recirculation of a portion of the hot combustion gases has the added important advantage that a portion of the dissociated water, and hence released oxygen, flows back centrally to the fuel entrance, whereby the combustion is additionally initiated from the inside of the hollow sprayed cone of fuel.

The significance of the invention will become immediately apparent if one considers how long the combustion times of coal are in comparison to the combustion times of oil or wood. The particle path has to be accordingly long so as to obtain a relatively complete degree of combustion. This is what gives rise to the conventional long combustion chambers mentioned above. The inventive features provide that the necessarily long particle path is produced by the spontaneous fanning out of the hollow sprayed cone of fuel, that the fuel particles are conveyed along a spiral path or flow and that a partial recirculation is achieved back to immediately in front of the fuel entrance at all degrees of load and in the shortest distance in the direction of the central axis of the fuel entrance or of the combustion chamber.

It should also be mentioned that for starting combustion pure oil is injected first through the entrance opening which then becomes increasingly mixed with pulverized solid fuels, e.g. pulverized coal, and, if required, with water. The oil can finally be completely replaced by water. This depends to a certain extent on the consistence of the coal to be burned or the like. The oil injection at the start facilitates ignition. The opposite is true when the combustion is to be stopped. The flow of pulverized fuel is reduced until only oil remains as a fuel. In this way, lumping of the fuel and blocking of the fuel entrance is avoided when switching off the apparatus. Principally coal comes into question as a solid fuel, e.g. hard coal, bitumenous lignite, gassy coal or mixtures thereof.

The combustion behavious of coal/water/oil mixtures has long been the subject of research (see "Verfahrenstechnische Berichte" (technical reports), 1967, p. 648). Results have shown that it is extremely difficult to control such a fuel. The invention discloses a new successful method for doing so.

U.S. Pat. No. 4,023,921 describes the provision in oil burners of two secondary air currents which are concentric with respect to the entrance port. However, it describes no features for providing rotation or throughput variation of these partial flows which enable maximum recirculation of a portion of the hot combustion gases and small remainders of unburnt fuel at various states of operation. The secondary air flows according to U.S. Pat. No. 4,023,921 have the task of cooling the fuel entrance port and blowing sufficient air into a secondary combustion zone in the combustion chamber for the purpose of after-burning the fuel.

BRIEF DESCRIPTION OF THE DRAWINGS

In the following, preferred embodiments of the inventive means will be described in more detail with reference to the drawing, in which.

DETAILED DESCRIPTION OF PREFERRED EMBODIMENTS OF THE INVENTION

Figure 1:
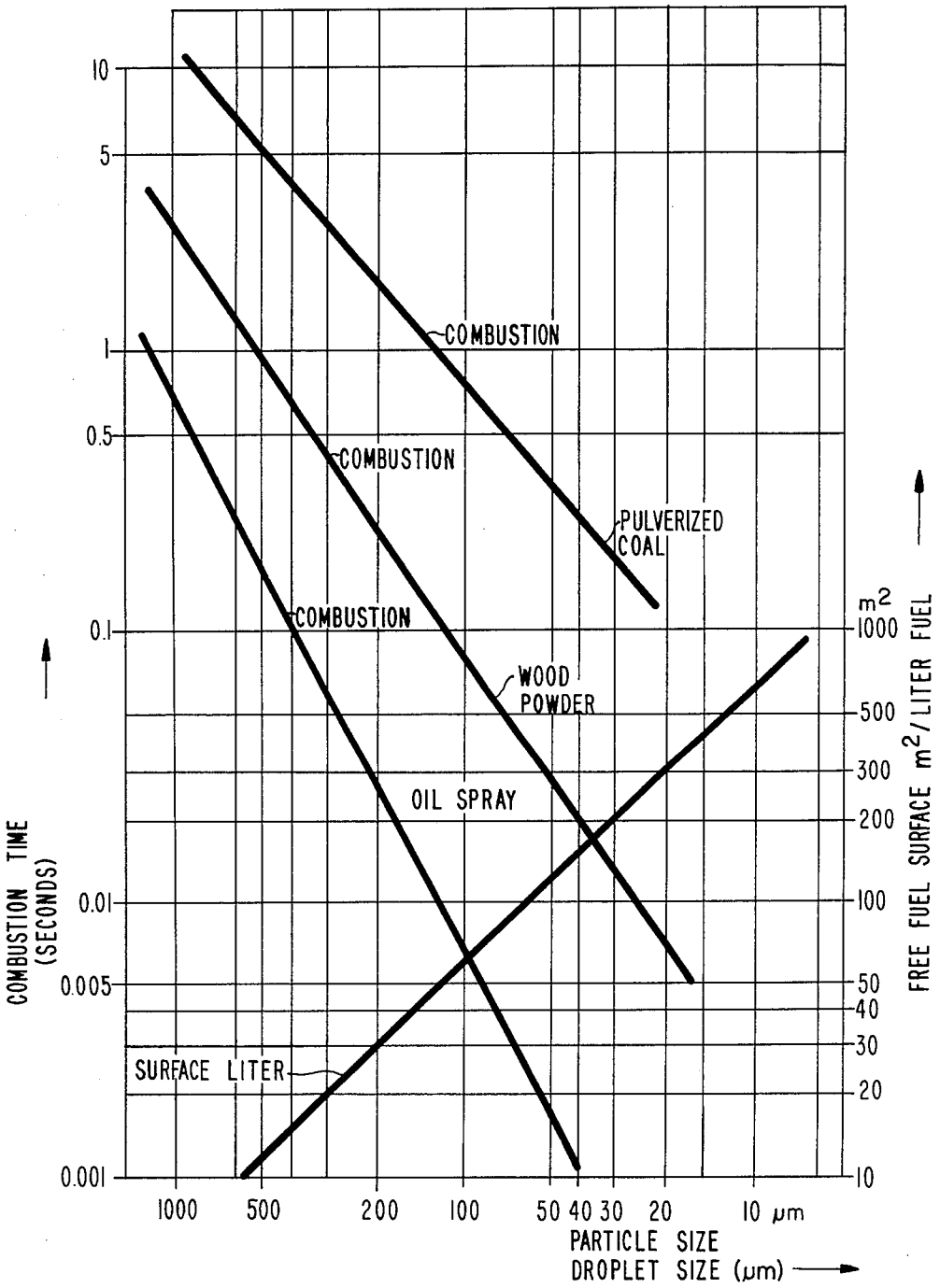
FIG. 1 is a graphical representation of the combustion time and the free fuel surface of oil, wood and coal, dependent on the particle size or droplet size respectively.

FIG. 1 shows that the combustion time of carbon particles is substantially longer than the combustion time of wood particles or oil droplets. The characteristic curves for the combustion times of coal, wood and oil are equal dependent on the particle size or droplet size and hence dependent on the free surface per unit of volume. This means that a much longer particle distance is necessary to completely burn pulverized coal than is required to burn oil, for example. For this reason the combustion chambers of traditional coal burners are very long so as to be able to accomodate the long jet flame associated therewith. By virtue of the inventive features as described above and will be described in the following in more detail with reference to a preferred embodiment example, complete combustion of pulverized coal is accomplished over a very short distance, i.e. the combustion chamber is extremely short.

Figure 2:
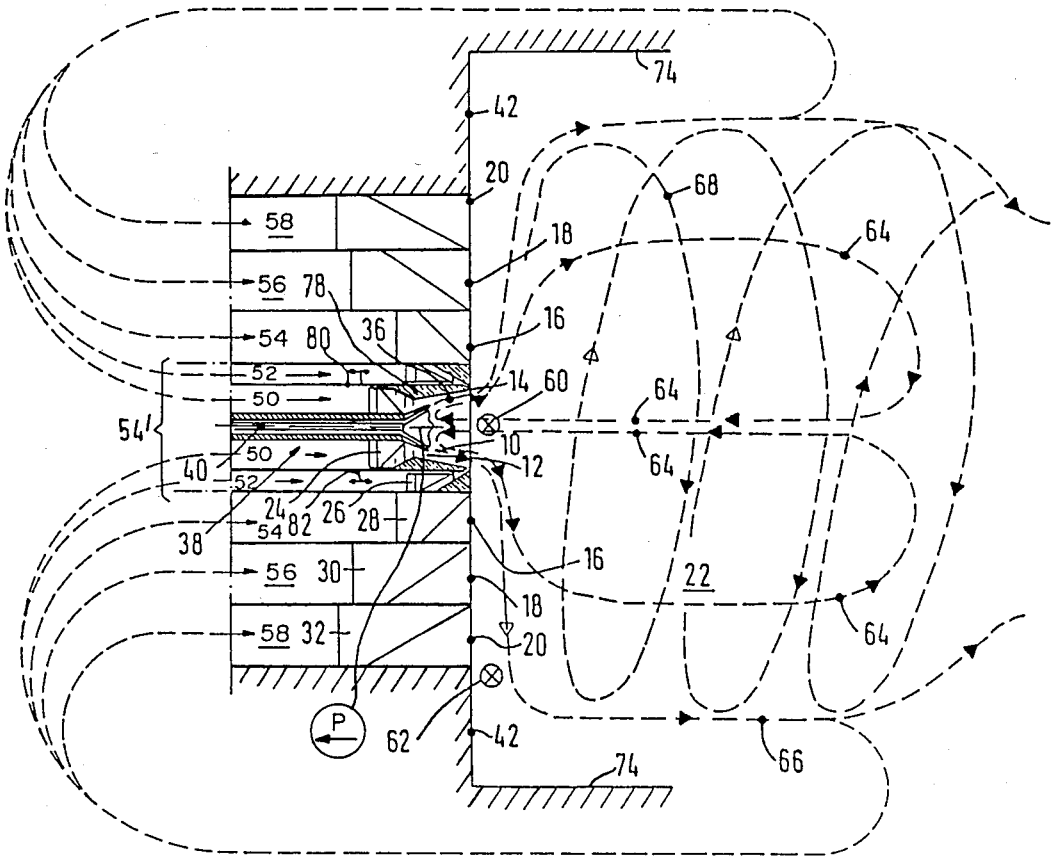
FIG. 2 shows a schematic longitudinal section of an inventive means (combustion member)

The coal burner illustrated in FIG. 2 in a schematic longitudinal sectional drawing comprises a tubular tuyère orifice 38 with a substantially annular entrance port 10 opening into the combustion chamber 22. The width of the entrance port can be modified by changing the relative position of the side walls 46, 48 limiting the annular entrance port 10. The side walls 46, 48 are tapered in the embodiment example shown and therefore the fuel emulsion assumes a hollow cone-shaped flow configuration upon leaving the annular entrance port 10. This configuration then fans out extensively and assumes a bell or apple-shaped configuration.

The tuyère orifice 38 is concentrically surrounded by a first gas passage 30 (see FIG. 3) whose entrance port 12 opening into the combustion chamber 22 is adjacent to the entrance port 10 for the fuel emulsion. What is known as "primary inlet air", which may be enriched with combustion gases of higher temperatures, flows through gas passage 50. The gas passing through port 12 has a flow velocity of 100 to 200 m per second, preferably about 130 m per second. The side walls 46' and 48' limiting the port 12 (see FIG. 3) are also tapered similar to the side walls 46, 48 limiting the annular entrance port 10 for the fuel emulsion. Immediately before the "primary inlet gas" flows out, it is deflected by about 70 degrees by means of guide blades 24 and is thus set in rotation about the longitudinal axis 40 of the entrance port 10 or combustion chamber 22. The primary inlet gas is blown into the gas chamber 50 at a pressure of about 1000 to 1200 mm pressure of water.

Figure 3:
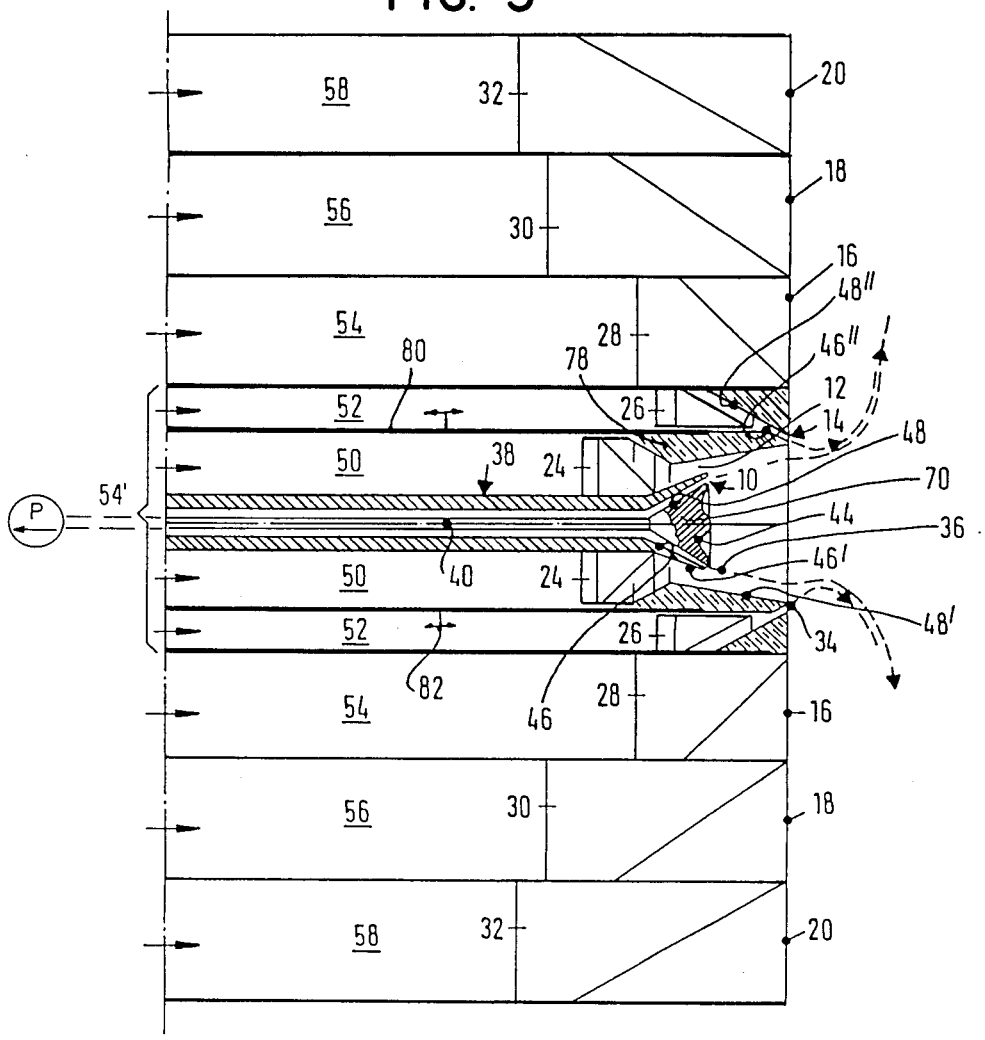
FIG. 3 shows the tubular tuyère for the fuel and gas registers or passages of the burner according to FIG. 2 on an enlarged scale.

The gas passage 50 is concentrically surrounded by a further gas passage 52 (see FIG. 3) whose annular entrance port 14 opening into the combustion chamber 22 is also limited by tapered side walls 46" and 48" (see FIG. 3). The side walls 46", 48" are, however, arranged so as to give the gas flowing out of the annular port 14 a tapered flow configuration which penetrates the tapered flow configuration of the fuel emulsion flowing out of the annular port 10 or the gas flowing out of the annular port 12. Due to this and due to the fact that the annular ports 10 and 12 are set aback with respect to the annular port 14, the closed hollow cone-shaped flow configuration is broken up by the gas flowing out of the annular port 14 and it then reaches the fuel emulsion which has already set set in rotation. It therefore achieves an additional enlargement of the free surface of the fuel shortly after it leaves the tuyère orifice or shortly after it enters the combustion chamber 22.

Before the "secondary inlet air" flowing through the gas passage 52 is emitted it is also deflected by about 40 or 45 degrees with respect to the longitudinal 40 of the tuyère orifice 38 by means of the guide plates 26 arranged in the region of the annular port 14, i.e. it is set in rotation about the longitudinal axis 40. The emission velocity of the "secondary inlet air" amounts to between about 120 and 180 m per second, preferably 140 m per second. The width of the annular gap of the port 14 can also be changed by modifying the relative position of the side walls 46", 48" limiting it. The emission velocity of the "secondary inlet air" can of course also be varied in a similar manner. The "secondary inlet air" is blown into the annular passage 52 also at a pressure of approximately 1000 to 1200 mm pressure of water. The "secondary inlet air" is deflected by the guide plates 26 in the same direction as the deflection of the "primary inlet air" by the guide plates 24 arranged in the region of port 12.

The "secondary inlet air" is preferably not enriched with hot combustion gases because it does not serve so much as a carrier for the fuel emulsion injected into the combustion chamber 22 but serves instead to enlarge the free surface of the fuel emulsion and to enrich or supply the fuel particles with oxygen.

The component 54 comprising the tuyère orifice 38, the annular passage 50 immediately surrounding the latter and the annular passage 52, through which the "secondary inlet air" flows, can be inserted as a unit into the end wall 42 of the combustion chamber 22 or into the gas register 54, 56, 58, which will be described below (see FIG. 3) and can therefore easily be replaced by a corresponding but somewhat modified component.

The gas passage 52 for the "secondary inlet air" is surrounded by a concentric gas passage 54, the latter is surrounded by a further concentric gas passage 56 and this is also surrounded by a still further concentric gas passage 58. The respective annular ports opening into the combustion chamber 22 are indicated in FIGS. 2 and 3 by references 16, 18, and 20. Preferably air is selectively passed through the annular passages 54, 56, 58 and is blown in at a pressure of between about 200 and 300 mm pressure of water. Before the air is emitted from the annular gas or air entrance ports 16, 18, 20 it is deflected by the guide blades 28, 30, 32 arranged in the regions of the ports 16, 18, 20, and is therefore set in rotation about the longitudinal axis 40 in the same direction as the "primary inlet air" or "secondary inlet air" by means of guide blades 24, 26.

The gas flow can be deflected by about 70 degrees by means of the guide blades 28. The guide blades 30 and 32 cause the gas flow to be deflected by about 40 to 50 degrees and 0 to 40 degrees respectively. All guide blades, in particular the outer guide blates 32, can be adjusted with respect to their angular position and can therefore be adjusted to suit the fuel to be burned.

The velocity of flow of the air emitted from the annular port 16 amounts to about 40 m per second at the start of combustion and amounts to about 70 m per second at full load. The flow velocity of the air emitted from the annular ports 18 and 20 varies between 0 m per second at the beginning of combustion and 70 m per second at full load.

The emission velocities of the "primary inlet air" out of annular port 12 and the "secondary inlet air" out of annular port 14 remain approximately the same between start and full load in all states of operation. Only the emission amount or the throughtput are changed by appropriate enlargement of reduction of the width of the annular ports or annular gaps 12 and 14. The modification of the gap widths of the annular ports or gaps 12 and 14 are carried out in the same manner. For this purpose an annular orifice 78, which is arranged between the two annular openings or gaps 12 and 14 and which comprises the two side walls 48' and 46", which are adjacent and facing each other, of the two annular openings or gaps 12 and 14, is arranged so as to be reciprocally movable in the axial direction or in the direction of the longitudinal axis 40 (double arrow 82 in FIG. 3). The annular orifice 78 in the embodiment examples in accordance with FIGS. 2 and 3 is connected to the pipe sleeve 80 separating the two inlet air passages 50, 52 such that the axial movement of the annular orifice 78 is carried out by appropriately moving the pipe sleeve 80. At the start, the annular orifice 78 in FIG. 3 is moved towards the right, so that the gap widths or annular ports or gaps 12 and 14 and hence the amount of inlet air being emitted are at a minimum. At full load the opposite is the case, i.e. the annular orifice in FIG. 3 is moved towards the left such that the annular ports or gaps 12 and 14 are opened to a maximum. The amount of "primary" and "secondary" inlet air is thereby also at a maximum.

By virtue of the described arrangement and configuration of the inlet opening 10 for the fuel emulsion opening into the combustion chamber 22 and the inlet openings 12, 14, 16, 18, 20 for gas flow causing the rotation of the injected fuel emulsion or individual gas flows, a low pressure of approximately between 400 and 500 mm pressure of water in relation to the atmospheric pressure is built up in the region of the longitudinal axis 40 immediately behind the inlet opening 10 for the fuel emulsion and a low pressure of about between 40 and 50 mm pressure of water in relation to the atmospheric pressure is built up in the region of the gas register 16, 18, 20 on the end side. The above-mentioned low pressure ranges are indicated in FIG. 2 by the references 60 and 62. Due to the low pressure built up in the central region of the annular entrance port 10, a recirculation 64 of a portion of hot combustion gases and a remainder of unburnt fuel particles is started towards entrance port 10. The recirculation 64 occurs across the whole of the bell-shaped or apple-shaped flow configuration 66 (flame region).

The centrally recirculating hot combustion gases, which have a temperature ranging between 1500 and 1700 degrees C., are deflected at the central end surface within the annular port 10 and are swept back into the combustion chamber 22 by the injected fuel emulsion. The hot combustion gases thereby cause the relatively cold fuel emulsion to flame up immediately after is flows out, so that the combustion process is started relatively close to the fuel entrance 10. The outer flow configuration 66 (flame region) is determined by the balance brought about between the centrifugal forces caused by rotation 68 and the forces caused by the flow pressure prevailing outside the flow configuration 66 in the region 62 of the end walls 42, on the one hand, and the counter-forces caused by the central low pressure in the region 60 within the flow configuration 66, on the other hand.

The two outer gas or air passages 56, 58 are closed upon initiation of combustion. The annular opening 16 is adjusted such that the velocity of the air flowing out therefrom amounts to about 40 m per second. The annular orifice 78 is—as illustrated—moved in the direction towards the combustion chamber 22 so that the annular gaps between the side walls 46', 48' and 46'', 48'' are reduced, whereby the outlet volume of the "primary" and "secondary" inlet air is reduced at a somewhat increased outlet velocity. A higher "break-up" effect is obtained by means of the somewhat higher outlet velocity, in particular that of the "secondary inlet air" coming from the annular port 14. At the start, the inlet air is distributed such that about 60 to 70%, preferably 90% flows out of the fuel inlet 10 at the nearest adjacent annular port 12 and only about 30 to 40%, preferably 10% flows out of the second-nearest annular port 14.

At full load, the quantitative relation between "primary inlet air" and "secondary inlet air" amounts to approximately 3:7 with an increased total volume of inlet air. This shows that a strong concentrated gas flow in the immediate vicinity of the fuel emulsion is required at the start so as to break up the latter and to thereby set off combustion more easily due to the enlarged surface of the fuel or fuel emulsion. The described modification of the quantitative relation between "primary" and "secondary" inlet air while simultaneously changing the total capacity or outlet volume is simply obtained by means of an appropriate configuration of the axially movable annular orifice 78, for example as illustrated in either of FIGS. 2 or 3 (having an approximately trapezoidal cross section).

As shown in FIGS. 2 and 3 the central front surface within the annular port 10 is provided with a revolving or annular baffle channel 44 for supporting the recirculation and mixing of the hot combustion gases with the injected fuel emulsion. The central front surface within the annular port 10 may be coated with a heat-resistant material, e.g. ceramics. The complete inner cone 70 of the tuyère orifice 38 is made preferably of a heat-resistant material, e.g. ceramics, in the region of the annular entrance port 10.

In order to avoid collisions of recirculating combustion gases and, in particular, unburnt particles with the central front surface within the annular port 10, which could thereby cause deposits or crusts to be formed thereon, appropriate openings can be provided in the front surface to allow additional air to be blown into the combustion chamber such that the blown in air flows approximately spirally across the central front surface. In this way, the low pressure in front of the centre front surface can be adjusted and varied. Furthermore, the additional air (gas), which is blown in centrally, restrains circulating combustion gases and particles from the above-mentioned front surface. The accumulation of deposits and crusts on the front surface can thus be reliably avoided.

Figure 4:
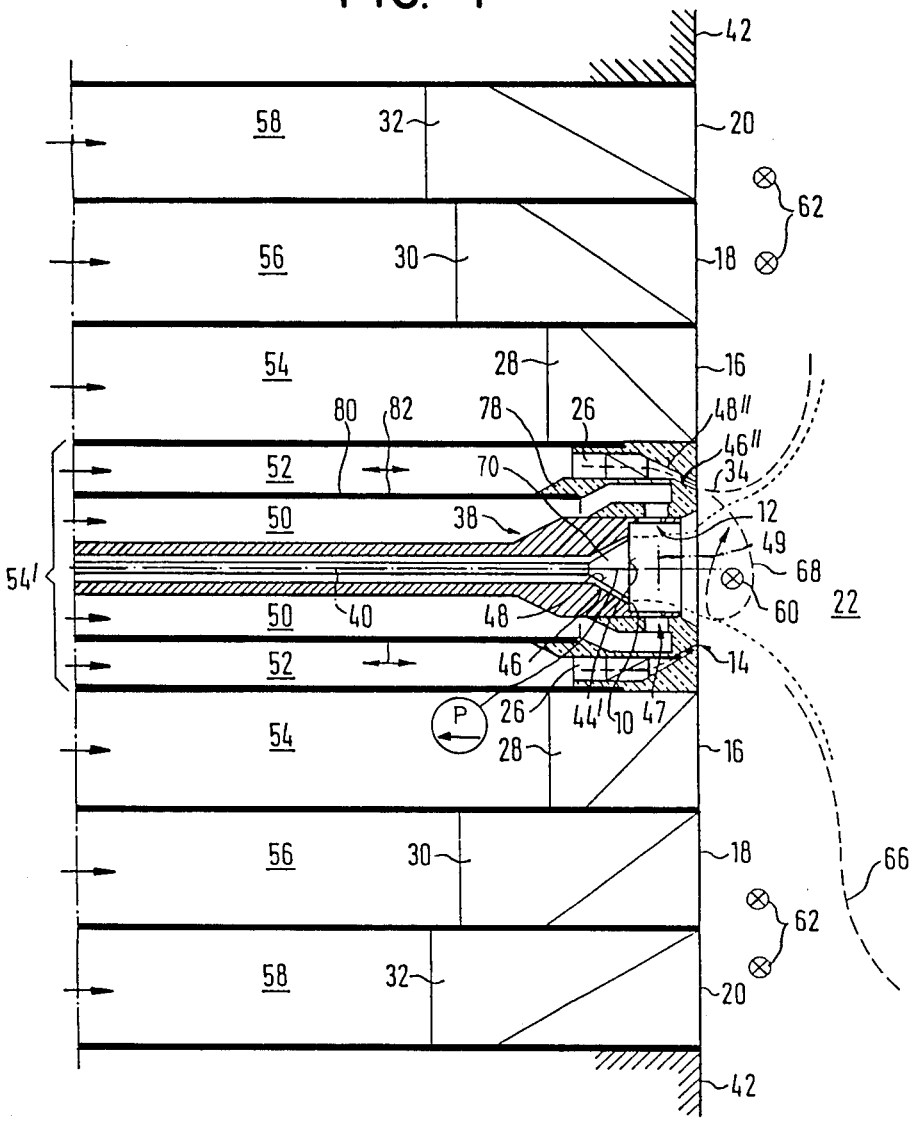
FIG. 4 shows a schematic longitudinal section of a variation of the burner section.
Figure 6:
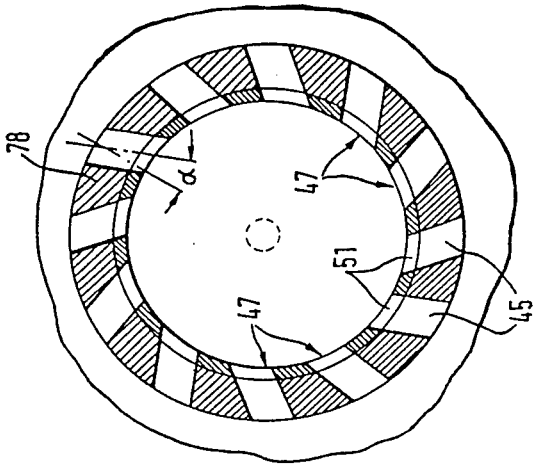
FIG. 6 is a sectional view of the burner part according to FIG. 5 along the line IV—IV in FIG. 5 on a reduced scale.
Figure 5:
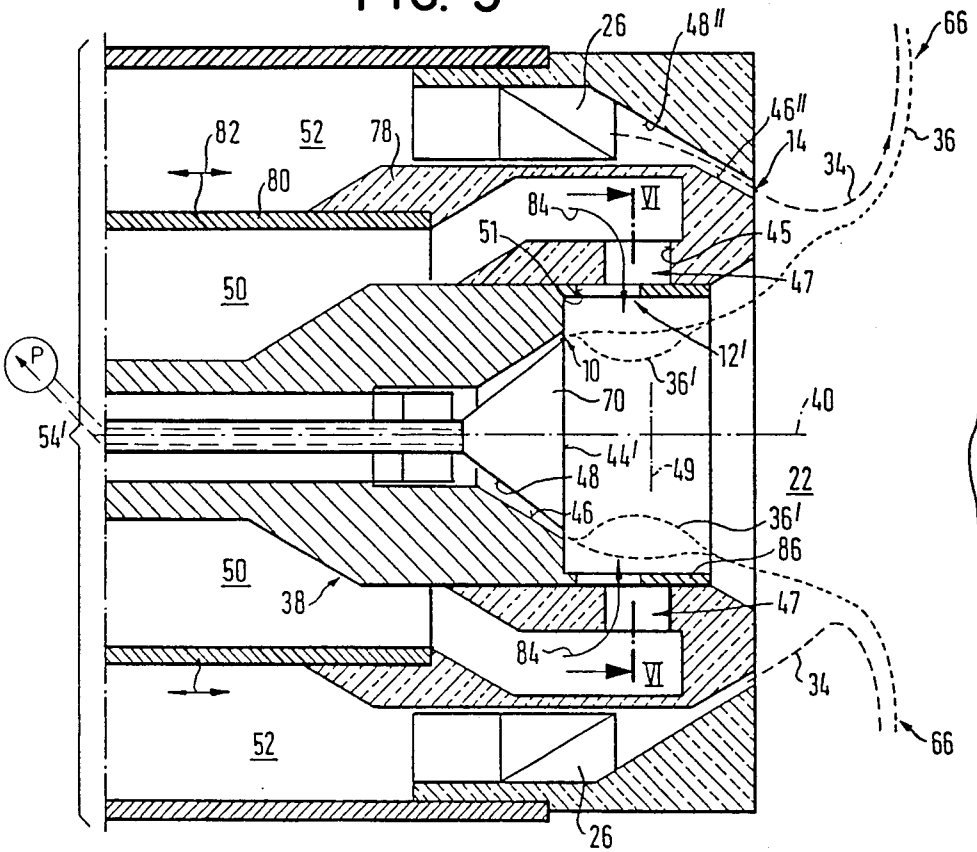
FIG. 5 shows the central burner section according to FIG. 4 on an enlarged scale.

The schematic longitudinal section of the coal burner shown in FIG. 4, which is modified in comparison to the embodiments shown in FIGS. 2 and 3, comprises a tubular tuyère orifice 38 with an approximately annular entrance port 10 which opens into the combustion chamber 22 and the gap width of which can be modified by changing the relative position of the side walls 46, 48 limiting the annular entrance port 10. The side walls 46, 48 are also tapered in the illustrated embodiment example, so that the fuel emulsion assumes a hollow cone-shaped flow configuration after it is emitted from the annular port 10. The flow configuration is then fanned out and assumes a bell-shaped or apple-shaped configuration. The tuyère orifice 38 is concentrically surrounded by a first gas passage 50, the entrance port 12' of which opens into the combustion chamber 22 and points in such a way that the flow of gas ("primary inlet air") is introduced in a plane extending perpendicular to the axis 40 of the entrance port 10 for the fuel emulsion opening into the combustion chamber 22. (See in particular FIG. 5 in which the "primary inlet air" introduced through the entrance port 12' into the combustion chamber 22 is indicated by arrow 84 denoting the flow. This flow gives the flow configuration 36 of the fuel a constriction or dent 36'.) As already explained, so-called "primary inlet air" flows through the gas chamber 50 and this air may be enriched with combustion gases at higher temperatures. The gas (air) emitted from port 12' has a flow velocity of approximately between 100 and 200 m per second, preferably approximately 130 m per second. As FIG. 5 shows, the entrance port 12' for the "primary inlet air" comprises a multiple, e.g. twelve, inlet ports 47 which are evenly distributed over its periphery and which all point at the same angle $\alpha$ to the radial axis. The angle $\alpha$ amounts to approximately between 10 and 25 degrees, preferably 15 degrees. In this way, the "primary inlet air" introduced into the combustion chamber 22 is set in rotation about the longitudinal axis 40 and this rotation is then transmitted to the fuel emulsion injected into the combustion chamber 22. The "primary inlet air" is usually blown into the gas chamber 50 at a pressure of between 1000 and 1200 mm pressure of water. If somewhat tougher fuel emulsions are to be burned, the pressure is preferably between about 2000 and 4000 mm pressure of water.

The gas passage 50 is concentrically surrounded by a further gas passage 52 (see FIGS. 2 and 3) whose annular entrance port 14 opening into the combustion chamber 22 is limited by tapered side walls 46'' and 48''. The side walls 46'', 48'' are arranged so as to give the gas flow emerging from the annular port 14 a tapered flow configuration which endeavors to penetrate the hollow cone-shaped flow configuration 36 of the fuel emulsion emerging from the annular port 10 and opening up in the direction of the combustion chamber 22. In this way and by virtue of the fact that the annular port 10 and the entrance port 12' are set aback with respect to the annular port 14, the closed hollow cone-shaped flow configuration 36 of the fuel emulsion, which by that time will have been set in rotation, is broken up, i.e. it achieves an additional enlargement of the free or effective surface of the fuel shortly after its emission from the tuyère orifice 36 or shortly after its entrance into the combustion chamber 22.

Before the so-called "secondary inlet air" flowing through gas passage 52 is emitted, it is deflected by the guide blades 26 arranged in the region of the annular port 14 and the deflection to between 40 and 45 degrees with respect to the longitudinal axis 40 of the tuyère orifice 38, i.e. it is set in rotation about th longitudinal axis 40. The emission velocity of the "secondary inlet air" amounts to between 120 and 180 m per second, preferably 140 m per second. The annular gap width of the port 14 can be modified by changing the relative position of the side walls 46", 48" limiting it. In a similar manner the volume emitted (capacity) of the "secondary inlet air" can of course be varied while the gas emission velocity remains substantially constant. The "secondary inlet air" is also blown into the annular passage 52 at a pressure of approximately 1000 to 1200 mm pressure of water. A higher pressure may be applied if somewhat tougher fuel emulsions are burned, e.g. between about 2000 and 4000 mm pressure of water. The "secondary inlet air" is deflected by the guide blades 26 in the same direction as the "primary inlet air" by the ports 47 of the primary air entrance port 12 inclined towards the radial axis.

The "secondary inlet air" is preferably not enriched with hot combustion gases since it is not intended so much to serve as a carrier for the fuel emulsion injected into the combustion chamber 22 but serves instead for enlarging the free or effective surface of the latter and for enriching the fuel particles with oxygen.

The component 54' comprising the tuyere orifice 38, the annular passage immediately surrounding the latter and the annular passage 52, through which the secondary inlet air flows, can be inserted as a unit into the end wall 42 of the combustion chamber 22 or into the gas register 54, 56, 58 which will be described below (see FIG. 2) and can therefore easily be replaced by a corresponding but somewhat modified component.

The gas passage 52 for the "seondary inlet air" is surrounded by a concentric gas passage 54, the latter is surrounded by a further concentric gas passage 56 and this is also surrounded by a still further concentric gas passage 58. The respective annular ports opening into the combustion chamber 22 are indicated in FIG. 2 by references 16, 18 and 20. Preferably air is selectively passed through the annular passages 54, 56, 58 and is blown in at a pressure of between 200 and 300 mm pressure of water. Before the air is emitted from the annular gas or air entrance ports 16, 18, 20 it is deflected by the guide blades 28, 30, 32 arranged in the regions of the ports 16, 18, 20, and is therefore set in rotation about the longitudinal axis 40 in the same direction as the "primary inlet air" or "secondary inlet air".

The gas flow can be deflected by about 70 degrees by means of the guide blades 28. The guide blades 30 and 32 cause the gas flow to be deflected by about 40 to 50 degrees and 0 to 40 degrees respectively. All guide blades, in particular the outer guide blades 32, can be adjusted with respect to their angular position and can therefore be adjusted to suit the fuel to be burned.

Th velocity of flow of the air emitted from the annular port 16 amounts to about 40 m per second at the start of combustion and amounts to about 70 m per second at full load. The flow velocity of the air emitted from the anuular ports 18 and 20 varies between 0 m per second at the beginning of combustion and 70 m per second at full load.

The emission velocities of the "primary inlet air" out of the slanted ports 47 and the "secondary inlet air" out of the annular port 14 remain approximately the same between start and full load in all states of operation. Only the emission amount or the throughput are changed by appropriate enlargement or reduction of the free cross-sections of the ports 47 of the annular port 14. The modification of the free cross-sections of the ports 47 and 14 are carried out in the same manner. For this purpose an annular orifice 78, which is arranged between the two ports 12' and 14 is arranged so as to be reciprocally movable in the axial direction or in the direction of the longitudinal axis 40 (double arrow 82 in FIG. 3). The annular orifice 78 in the embodiment example in accordance with FIGS. 4 and 5 is connected to the pipe sleeve 80 separating the two inlet air passages 50 and 52 such that the axial movement of the annular orifice 78 in the direction od double arrow 82 is carried out by appropriately moving the pipe sleeve 80. The annular orifice 78 comprises the inner radial side wall 46" of the annular port 14 for emitting the "secondary inlet air" and inlet ports 45, which extend in a plane approximately perpendicular to the longitudinal axis 40 of the combustion chamber 22 and whose free cross-section is in each case roughly elliptical. The annular orifice 78 is reciprocally mounted on a pot-shaped extension 86 of the tuyère orifice 38 in the axial direction, i.e. in the direction of the longitudinal axis 40 or in the direction of double arrow 82, and the pot-shaped extension 86 comprises ports 51 corresponding to the radial ports 45 contained in the annular orifice 78. By appropriately shifting the annular orifice 78 relative to the tuyère orifice 38, the two radial ports 45 and 51 can be made to coincide with each other; this is accomplished in FIG. 5 by shifting the annular orifice 78 to the left. At the start, the annular orifice 78 is moved towards the right (position as in FIG. 5) so that the gap width of the annular port 14 for the "secondary inlet air" and the free cross-section of the inlet port 12' for the primary inlet air" are each at a minimum. At full load the opposite is the case, i.e. the annular orifice in FIG. 3 is moved towards the left such that the annular port 14 for the "secondary inlet air" and the inlet port 12' for the "primary inlet air" are each open to a maximum. The radial ports 45 and 51 coincide exactly with each other in the latter position. The emission volume of "primary" and "secondary" inlet air is also at a maximum at the latter position.

By virtue of the described arrangement and configuration of the entrance port 10 for the fuel emulsion opening into the combustion chamber 22 and the entrance 12', 14, 16, 18, 20 for gas flow causing the rotation of the injected fuel emulsion or individual gas flows, a low pressure of about 400 to 500 mm pressure of water in relation to the atmospheric pressure is built in the region of the longitudinal axis 40 immediately behind inlet port 10 for the fuel emulsion and a low temperature of between 40 and 50 mm pressure of water in relation to the atmospheric pressure is built up in the region of the gas register 16, 18, 20 on the end side. The above-mentioned low pressure ranges are indicated in FIG. 4 by the references 60 and 62. Due to the low pressure built up in the central region of the annular entrance port 10, a recirculation of a portion of hot combustion gases and a remainder of unburnt fuel particles is started along the central longitudinal axis 40 which continues directly up to entrance port 10 for the fuel emulsion. The recirculation occurs across the whole of the bell-shaped or apple-shaped flow configuration 66 (flame region) which is only sketched in FIG. 4. The centrally recirculating hot combustion gases, which have a temperature ranging between 1500 and 1700 degrees C. are deflected at the central end surface within annular port 10 and are swept back into the combustion chamber 22 by the injected fuel emission. The hot combustion gases thereby cause the relatively cold fuel emulsion to flame up immediately after it emerges so that the combustion process is started relatively close behind fuel entrance 10. The outer flow configuration 66 (flame region) is determined by the balance brought about between the centrifugal forces caused by rotation and the forces caused by the low pressure prevailing outside the flow configuration 66 in the region 62 of the end walls 42, on the one hand, and the counter-force caused by the central low pressure in the region 60 within the flow configuration 66, on the other hand.

The two outer gas or air passages 56, 58 are closed upon initiation of combustion. The annular opening 16 is adjusted such that the velocity of the air flowing out therefrom amounts to about 40 m per second. The annular orifice 78 is—as illustrated—moved in the direction towards the combustion chamber 22 so that the annular gap between the side walls 46'', 48'' and the free cross-section of the inlet air port 12' are reduced (see position in FIG. 5), whereby the outlet volume of the "primary'-'and "secondary"inlet air is reduced at a somewhat increased outlet velocity. A higher break-up effect is obtained by means of the somewhat higher outlet velocity, in particular that of the "secondary inlet air" coming from annular port 14. At the start, the inlet air is distributed such that about 60 to 70%, preferably 90%, flows out of the fuel inlet 10 at the nearest adjacent port 12' and only about 30 to 40%, preferably 10%, flows out of annular port 14.

At full load, the quantitative relation between "primary inlet air" and "secondary inlet air" amounts—as has been explained in conjunction with FIGS. 2 and 3—to approximately 3:7 with an increased total volume of inlet air. This shows that at the start a strong concentrated gas flow in the immediate vicinity of the fuel emulsion is required so as to break up the latter and to thereby set off combustion more easily due to the enlarged surface of the fuel or fuel emulsion. The described modification of the quantitative relation between "primary" and "secondary" inlet air while simultaneously changing the total capacity or outlet volume in simply obtained by means of an appropriate configuration of the axially movable annular orifice 78 as illustrated in either of FIGS. 4 or 5. As shown in FIGS. 4 and 5 the central front surface within the annular port 10 is embodied so as to be plane. However, it may also be provided—as in the embodiment example according to FIGS. 2 and 3—with a substantially annular baffle for supporting the recirculation and mixing the hot combustion gases with the injected fuel emulsion. The central front surface within the annular port 10 may be coated with a heat-resistant material, e.g. ceramics. The complete inner cone 70 of the tuyère orifice 38 is made preferably of a heat-resistant material, e.g. ceramics, in the region of the annular entrance port 10.

In order to avoid collisions of recirculating combustion gases and, in particular, unburnt particles with the central front surface (reference 44' in FIG. 5) within the annular port 10, which could thereby cause deposits or crust to be formed thereon, appropriate openings can be provided in the front surface to allow additional air to be blown into the combustion chamber preferably such that the blown in air flows approximately spirally across the central front surface 44'. In this way, the low pressure in front of the centre front surface can be adjusted and varied. Furthermore, the additional air (gas) which is blown in centrally restrains circulating combustion gases and particles from the above-mentioned front surface. The accumulation of deposits and crusts on the front surface can thus be reliably avoided.

As has already been explained above, the deflection of the outer radial individual gas flow about the axis 40 caused by the guide blades 32 is less pronounced and may be even zero. In this way the radial expansion of the flow configuration or flame region 66 is substantially effected. In particular, one definitely avoids the fuel particles becoming deposited on the side wall 74 of the combustion chamber 22.

With a burning capacity of approximately 5 tons of coal per hour, the outer diameter of the exchangeable component 54' amounts to about 244 mm and the outer diameter of the outer annular passage 58 amounts to between 800 and 900 mm.

The mixing of combustion gases with the "primary inlet air", which is explained above, has two advantages. On the one hand, the fuel emulsion can be preheated on its way through passage 50. On the other hand, a certain amount of afterburning can be achieved which makes burning more efficient. The two advantages compensate the drawback of low oxygen content. This drawback can be simply removed by enriching the remaining individual gas flow ("secondary inlet air") with oxygen.

If a coal/water mixture is used as a fuel, wetting agents are preferably added which ensure even distribution of the coal particles in the water and thereby form an emulsion.

All of the features disclosed in these papers are claimed as salient features of the invention if they are novel over the prior art either individually or in combination.

What is claimed is:

1. A means for burning solid fuels, in particular coal, turf or the like in pulverized form, comprising a combustion chamber into which opens an entrance port for introducing the fuel, and further comprising an air entrance surrounding the fuel entrance port concentrically and comprising swirl elements setting the air flow in rotation, characterized IN THAT the air entrance is embodied as a register comprising a multiple of concentric air entrance ports, each of said air entrance ports being associated with swirl elements and the annular gap width of the two air entrance ports situated nearest to the fuel entrance can be modified by moving an annular orifice comprising the two adjacent side walls of the two air entrance ports in the direction of access of the fuel entrance port, the annular orifice preferably forming part of the pipe or similar sleeve separating the two partial air flows nearest to the fuel entrance port from each other, whereas the remaining air entrance ports situated radially somewhat further away from the fuel entrance port can be closed or opened individually.

2. A means according to 1 characterized IN THAT the end surface within the fuel entrance port is either embodied so as to be plane or is provided with a substantially annular baffle for supporting the deflection of the recirculating combustion gases and unburnt fuel particles.

3. A means according to claim 1, characterized in that the annular gap width of the fuel entrance port and the annular gap width of the two air entrance ports situated nearest to the fuel entrance port can be each modified by varying the relative position of the side walls limiting the entrance ports.

4. A means according to claim 1, characterized in that the air entrance port immediately adjacent to the fuel entrance port is arranged so as to be sunk into the end wall of the combustion chamber but is preferably sunk to a lesser extent than the central fuel entrance port.

5. A means according to claim 1 characterized in that the air entrance port situated second-nearest to the central fuel entrance is directed such that the corresponding air flow assumes an approximately hollow cone-shaped flow configuration aimed at the flow configuration of the fuel emulsion which is also preferably hollow cone-shaped.

6. A means according to claim 1 characterized IN THAT the taper angle of the hollow cone-shaped air flow configuration amounts to approximately 40 to 100 degrees, preferably about 80 degrees.

7. A means according to claim 1, characterized in that the fuel entrance port comprises an annular tuyère orifice which is movable along the axis of the entrance port and which, in particular, is arranged such that the entrance port is set aback with respect to the end wall of the combustion chamber associated therewith.

8. A means according to claim 7, characterized IN THAT a connection and an adjustable means for evacuating air (vacuum source) is provided within the fuel entrance port.

9. A means according to claim 1, characterized in that the air entrance port nearest to or immediately adjacent to the fuel entrance port is arranged in a plane extending approximately perpendicular to the axis of the fuel entrance port.

10. A means according to claim 9, characterized in that the air entrance port situated nearest to the fuel entrance port comrpises a multiple, at least three and preferably twelve, of entrance bores arranged evenly across its periphery and whose central axes respectively enclose an angle of about 10 to 30 degrees, preferably 15 degrees with the radial axis.

11. A means according to claim 9, characterized IN THAT the air entrance port situated nearest to the fuel entrance port comprises an annular opening which has a multiple of guide vanes or guide blades evenly distributed about its periphery, which guide vanes or guide blades respectively enclose an angle of about 10 to 30 degrees preferably 15 degrees, with the radial axis.

12. A means according to claim 9 characterized IN THAT the free cross-section of the air entrance ports is variable and can preferably be synchronously enlarged or reduced.

* * * * *